US005337962A

United States Patent [19]

Erb et al.

[11] Patent Number: 5,337,962

[45] Date of Patent: Aug. 16, 1994

[54] PNEUMATIC ATOMIZER HAVING IMPROVED FLOW PATHS FOR ACCOMPLISHING THE ATOMIZATION OF LIQUIDS

[76] Inventors: Elisha W. Erb, 94 Harvard St., Leominster, Mass. 01453; Darrel R. Resch, 711 Sugar Bay Way, Unit 209, Lake Mary, Fla. 32746

[21] Appl. No.: 36,341

[22] Filed: Mar. 24, 1993

[51] Int. Cl.[5] ..... B05B 7/08

[52] U.S. Cl. ..... 239/424.5; 239/426; 239/431; 239/434

[58] Field of Search ..... 239/418, 423–424.5, 239/426, 429–431, 433, 434, 419.5, 425.5

[56] References Cited

U.S. PATENT DOCUMENTS

| | | | |
|---|---|---|---|
| H100 | 8/1986 | Denton | 239/434 |
| 1,436,351 | 11/1922 | Metcalfe | 239/434 |
| 3,993,246 | 11/1976 | Erb et al. | 239/434 |
| 4,018,387 | 4/1977 | Erb et al. | 239/434 |
| 4,161,281 | 7/1979 | Erb et al. | 239/434 |
| 4,161,282 | 7/1979 | Erb et al. | 239/434 |
| 4,261,511 | 4/1981 | Erb et al. | 239/434 |

FOREIGN PATENT DOCUMENTS

| | | | |
|---|---|---|---|
| 318061 | 8/1929 | United Kingdom | 239/434 |
| 9116991 | 11/1991 | World Int. Prop. O. | 239/434 |

*Primary Examiner*—Karen B. Merritt
*Attorney, Agent, or Firm*—Julian C. Renfro

[57] ABSTRACT

An atomizer device capable of reducing a flowable liquid to an ultrafine dispersion of liquid particles in a propellant gas, comprising a generally smooth surface having a central portion and a peripheral portion surrounding the central portion. At least one orifice is located in the surface, in at least a partially surrounding relationship to the central portion. A propellant gas is supplied to the underside of the surface, with such propellant gas being caused to pass at considerable speed through the orifice or orifices, thus forming at least one gas jet. The propellant gas flowing through the orifice or orifices create an area of low pressure at the central portion of the surface, and create at least one passway extending radially inwardly from the peripheral portion to the central portion, which passway, quite importantly, avoids direct contact with said gas jet. Liquid to be atomized is supplied at the location of the passway, which liquid is then swept through the passway toward the area of low pressure by ambient gas flowing through the passway to the area of low pressure. From this location within the overall envelope of the propellant gas flowing out of the orifice or orifices, the liquid is entrained into the propellant gas, such entrained liquid breaking into very fine droplets in the propellant gas.

14 Claims, 7 Drawing Sheets

PNEUMATIC ATOMIZER HAVING IMPROVED FLOW PATHS FOR ACCOMPLISHING THE ATOMIZATION OF LIQUIDS

RELATIONSHIP TO PREVIOUS INVENTIONS

This invention bears a distinct relationship to the following U.S. patents we have earlier obtained:

| ERB & RESCH | |
|---|---|
| U.S. Pat. No. 3,993,246 ('246) | "NEBULIZER & METHOD" |
| U.S. Pat. No. 4,018,387 ('387) | "NEBULIZER" |
| U.S. Pat. No. 4,161,281 ('281) | "PNEUMATIC NEBULIZER & METHOD" |
| U.S. Pat. No. 4,161,282 ('282) | "MICROCAPILLARY NEBULIZER & METHOD" |
| U.S. Pat. No. 4,261,511 ('511) | "NEBULIZER & METHOD" |

BACKGROUND OF THE INVENTION

A pneumatic atomizer is a device that uses a flow of gas to disperse a flowable liquid as small droplets. The present invention concerns an improved pneumatic atomizer for producing a fine dispersion of a flowable liquid in a gas. Several devices known for pneumatically atomizing a flowable liquid involve elements that produce a thin liquid filament or a thin liquid film and introduce the thin liquid filament or film to an adjacent high speed flow of gas. Examples of such devices include devices that:

(a) In accordance with the Erb and Resch U.S. Pat. No. 3,993,246 and Erb and Resch U.S. Pat. No. 4,018,387, liquid to be atomized is supplied between two elements, one of which is flexible and can be adjusted to provide a restricted outlet between the elements, the restricted outlet being in communication with a high speed flow of gas;

(b) In accordance with the Erb and Resch U.S. Pat. No. 4,261,511, liquid to be atomized is supplied through shallow passages between two contacting elements, the outlet of the passages being in communication with a high speed flow of gas; and (c) In accordance with the Erb and Resch U.S. Pat. No. 4,161,281 and Erb and Resch U.S. Pat. No. 4,161,282, a controlled flow of the liquid to be atomized is supplied onto an exposed smooth surface that has an edge in communication with a high speed flow of gas whereby the liquid flows across the exposed surface as a thin film of liquid into the flowing gas.

All of such pneumatic atomizers involve an outlet orifice for the gas flowing through the atomizer, the gas outlet orifice passing through an exterior surface of the atomizer that is approximately perpendicular to the gas flow as the gas exits the gas orifice. An unavoidable consequence of gas flowing through a surface that is approximately perpendicular to the gas flow at the point where the gas exits the atomizer, as a gas eddy naturally forms just above the surface. The gas eddy surrounds the gas exiting the gas orifice, and this gas flows in a circular course. The gas in the gas eddy may thus be regarded as flowing in a course that commences in the gas flowing out of the atomizer at a place which is just downstream from the gas exit orifice, then flowing with the column of gas flowing out of the atomizer, then flowing perpendicular to the column of such gas, then flowing back toward the surface of the atomizer, then flowing across the surface of the atomizer to reenter the column of gas flowing out of the atomizer.

It is to be noted that the gas eddy has been the source of large droplets in the output of prior art pneumatic atomizers of the types described above, and for certain usages, such large droplets are undesirable. The gas eddy naturally contains gas from the column of gas flowing out of the atomizer. Such gas comes from the column of gas exiting the atomizer a short distance downstream in the gas flow from where the gas exited the atomizer and contains liquid droplets that were formed in the atomizer. It is to be realized that any liquid droplets that be in the gas that enters the gas eddy are carried into the gas eddy by such gas. The droplets are swept toward the atomizer by the gas in the eddy circulating back toward the atomizer. The gas circulating in the eddy toward the atomizer turns a short distance above the face of the atomizer to flow across the face of the atomizer towards the gas orifice, and as a consequence, many of the droplets in the circulating gas fly out of the eddy.

Quite a number of such droplets impact on the face of the atomizer around and about the gas orifice and any structural element of the atomizer that surrounds the face of the atomizer, such as the top plate in the aforementioned Erb and Resch Patents '281 and '282, wetting the face of the atomizer and any surrounding structural element.

The droplets collect as large droplets on the face of the atomizer and the surrounding structural element. Visually it appears as though the face of the atomizer and the surrounding structural element were sweating large droplets. The large droplets are swept by the gas flowing in the gas eddy toward the gas orifice and into the column of gas exiting the atomizer. The gas flowing out of the atomizer shatters the large droplets into small droplets when the large droplets come into contact with the gas flowing out of the gas orifice and carries the small droplets away within the column of gas leaving the atomizer. The droplets that are the result of the foregoing generally are not as small as the very small droplets initially formed by the atomizer.

The consequence of this is that the column of gas leaving the atomizer contains (a) the very small droplets initially formed by the atomizer and (b) the unwanted relatively large small droplets that are the result of the naturally occurring gas eddy.

It is the purpose of this invention to provide an atomizer that improves upon these results.

SUMMARY OF THE INVENTION

In accordance with this invention, we provide an atomizer device capable of reducing a flowable liquid to an ultrafine dispersion of liquid particles in a propellant gas. This involves the use of a generally smooth surface having a central portion as well as a peripheral portion surrounding the central portion. Orifice means are disposed in this surface, in at least a partially surrounding relationship to the central portion. Propellant gas is supplied to the underside of the surface to cause such propellant gas to pass at considerable speed through the orifice means, thus forming at least one gas jet. The propellant gas flowing through the orifice means creates an area of low pressure at the central portion of the surface, with the flow of gas from the orifice means creating at least one passway extending radially inwardly from the peripheral portion to the central portion. Quite advantageously, this passway avoids direct contact with the gas jet. Liquid is supplied at the location of the passway, which liquid is then swept through the passway toward the area of low pressure by ambient gas drawn through the passway to the area of low pressure. From this location the liquid is entrained into the propellant gas flowing out of the orifice means, such entrained liquid breaking into very fine droplets in the propellant gas.

As will be seen in greater detail hereinafter, the orifice means we utilize in accordance with this invention may take the form of an orifice of generally C-shaped configuration, a closely spaced pair of slots disposed in an essentially parallel relationship, or it may take the form of at least three orifices disposed in the configuration of a regular polygon. The generally smooth surface may be substantially flat, or it may have a concave central portion. It will also later be seen that the means for supplying the liquid to be atomized is disposed at the peripheral portion of the surface, at a location radially in line with the passway or passways of the device.

A primary object of the instant invention is to provide a novel atomizer functioning to substantially reduce the amount of relatively large droplets in the column of gas flowing out of an atomizer of the type that involves supplying the liquid to be atomized onto an exposed smooth surface that has an edge in communication with a flowing gas, on account of the naturally occurring gas eddy. Examples of this are the Erb and Resch Patents '281 and '282. This objective is achieved herein by forming on the exposed smooth surface, an area that is encircled by one or more gas orifices, except for at least one gap. This gap forms what may be regarded as a passway on the exposed surface that connects the encircled part of the exposed surface with that part of the exposed surface located exterior the encircled part of the exposed surface. The liquid to be atomized is supplied to a channel, with this channel directing the liquid to be atomized to the passway on the exposed surface. From this passway the liquid flows onto the encircled area where the liquid comes into contact with and enters gas flowing from the gas orifice or orifices that surround the encircled part of the exposed surface.

Because the liquid enters the gas leaving the atomizer from an exposed surface that may be regarded as within the overall column of gas exiting the atomizer, the overall column of gas exiting the atomizer contains liquid droplets at and about the center of the column for some distance downstream from the exit of the atomizer and is relatively free of liquid droplets near the perimeter of the overall column. The gas eddy that surrounds the overall gas column draws gas from the overall gas column into the gas eddy a short distance downstream from the atomizer's exit. Such gas comes from the perimeter of the overall gas column. Because such gas is relatively free of droplets, the gas eddy is relatively free of liquid droplets, with the result that substantially fewer droplets impact on the face of the atomizer and any surrounding structure, thereby substantially reducing the quantity of unwanted relatively large droplets in the column of gas flowing from the pneumatic atomizer.

As stated above, the principal object of the instant invention is to substantially reduce the amount of relatively large droplets in the column of gas flowing out of an atomizer of the type that involves supplying the liquid to be atomized onto an exposed smooth surface that has an edge in communication with a flowing gas, such as the Erb and Resch Patents '281 and '282. A very beneficial consequence of surrounding part of the exposed surface onto which the liquid to be atomized is flowed by one or more gas orifices, except for at least one gap, and causing propellent gas to flow outwardly through such gas orifices, is the ambient gas just above the surrounded part of the exposed surface is drawn into—and carried away by—the gas flowing out of the gas orifices, creating a vacuum in the space just above the surrounded part of the exposed surface. The gaps in the surrounding gas orifices result in narrow open spaces or fissures in the overall column of gas exiting the atomizer for a short distance above the face of the atomizer.

Gas from the gas eddy surrounding the overall column of gas exiting the atomizer is drawn by the vacuum through the fissures in the overall column of gas to the space just above the surrounded part of the exposed surface. The fissures in the overall column of gas may be regarded as passways to the interior of the overall column of gas flowing out of the atomizer. Liquid is supplied to that part of the exposed surface located exterior the surrounded part of the exposed surface through channels that direct the liquid onto the exposed surface near the outer ends of the passways. The gas rushing through said passways towards the space just above the surrounded part of the exposed surface sweeps any liquid on the exposed surface in the vicinity of the outer end of a passway through the passway onto the surrounded part of the exposed surface, thereby directing through the passways onto the surrounded part of the exposed surface substantially all the liquid supplied through the channels to the exterior part of the exposed surface, thereby substantially preventing the liquid supplied to the exterior part of the exposed surface from coming into contact with gas exiting the gas orifices until the liquid has come onto the surrounded part of the exposed surface. The liquid, upon reaching the surrounded part of the exposed surface, is entrained into the propellent gas flowing out of the surrounding gas orifices, the entrained liquid breaking into very fine droplets in the propellent gas.

The atomizers disclosed in the Erb and Resch Patents '281 and '282 require the liquid be supplied to the exposed smooth surface through liquid exit orifices sufficiently small that when filled with liquid the liquid is retained therein by capillary attraction and is prevented from flowing therefrom under ambient conditions except as liquid is supplied through said liquid passages to said exit orifices. The "sufficiently small" requirement is a source of difficulty for such atomizers if the liquid to be atomized contains undissolved solids, such as a dispersal of micro-fine powdered pesticide in a carrier liquid.

The instant invention does not require the channels through which the liquid is supplied to the exposed smooth surface be "sufficiently small". This is because the gas rushing through the passways described above to the surrounded part of the exposed surface sweeps whatever exposed liquid is in the channels with much force across the exposed part of the exposed surface and through the passways to the surrounded part of the exposed surface, accelerating the liquid and drawing the liquid out into a thin ribbon as the liquid passes from the exterior part of the exposed surface, through the passways, to the surrounded part of the exposed surface, thereby causing the liquid to be in the ideal state for being broken up, a thin ribbon, when the liquid comes into contact with the gas flowing out of a gas orifice.

In some configurations of gas orifices through the exposed surface, the vacuum described above can be enhanced by slightly to moderately depressing the center of the surrounded part of the exposed surface, thereby causing the exposed surface to be concave.

The instant invention may be practiced by one or more gas orifices through an exposed smooth surface pneumatic atomizer of the type disclosed in the Erb and Resch Patents '281 and '282, provided the gas orifice or orifices substantially encircle at least one part of the exposed smooth surface and provided further there is at least one gap in the surrounding orifice or orifices that forms what may be regarded as a passage on the exposed surface on which liquid can flow to enter onto the substantially surrounded part of the exposed surface. As an example, the instant invention may be practiced by utilizing a single gas orifice shaped like the letter "U" or the letter "C", with the liquid to be atomized directed to the opening that leads to the center of the "U" or "C".

As will be seen in more detail hereinafter, the instant invention may also be practiced by utilizing two long, side-by-side gas orifices with the liquid to be atomized directed to the space between the gas orifices.

The instant invention may also be practiced by utilizing three gas orifices, each located at the point of what may be regarded as a triangle, the triangle being of such size and shape and the gas orifices being of such size and shape as to substantially enclose an area on the exposed surface and leave at least one gap between the gas orifices.

The preferred embodiments of the instant invention utilize four to eight circular gas orifices, each of the same diameter, each located at a corner of what may be regarded as a regular polygon, thereby encircling the part of the exposed surface located within the polygon formed by the gas orifices and leaving on the exposed surface equal width gaps between neighboring gas orifices.

It is to be understood that the prior art discloses pneumatic atomizers that involve supplying the liquid to be atomized at a controlled rate onto an exposed smooth surface that has an edge in communication with a gas flowing through several gas orifices through the exposed surface, which gas orifices may be regarded as surrounding a part of the exposed surface, leaving a gap on the exposed surface between the gas orifices that may be regarded as a passway between the surrounded part of the exposed surface and that part of the surface located exterior the surrounded part of the exposed surface. Examples of the foregoing are FIG. 9 in the Erb and Resch Patent '281 and FIG. 9 in Erb and Resch Patent '511. The prior art also discloses pneumatic atomizers of the type described above in which the liquid to be atomized is directed by depressions in the smooth surface to the vicinity of the gas orifice or orifices, such as FIGS. 7, 9 and 11 in Erb and Resch Patent '281. The combination of the two essential components of the instant invention—(a) surrounding a part of the exposed smooth surface by one or more gas orifices, leaving what may be regarded as a passway on the exposed surface between the gas orifices and (b) directing the liquid to be atomized by a channel to a place on the smooth surface that is near a gap between the gas orifices, not to the vicinity of the gas orifice, so that the liquid is drawn across the smooth surface and through the passway to the surrounded part of the exposed surface, not to nearest edge of a gas orifice - is not taught by the prior art.

Likewise, the prior art does not teach the unexpected benefits that are achieved by directing the liquid to be atomized to the passways formed on the exposed surface by the gaps between the gas orifices so that the liquid to be atomized is deflected away from the gas orifices until after the liquid has been drawn onto the part of the exposed surface surrounded by the gas orifices.

DETAILED DESCRIPTION

Figure 1:
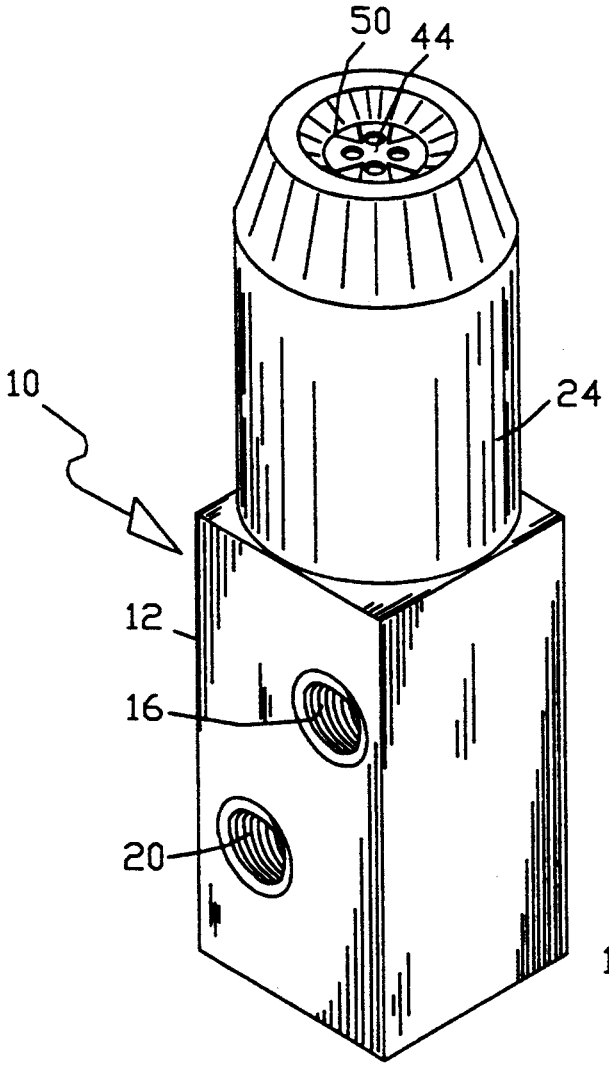
FIG. 1 is a perspective view of a pneumatic atomizer according to one embodiment of the present invention, shown approximately in operational form.

With initial reference to FIG. 1 of the drawing, we here illustrate an important embodiment of our invention, involving an atomizer device 10, consisting of a body member 12 containing on its sidewall a threaded passageway 16 for the injection of a gas, such as air, and adjacent which is a threaded passageway 20 for the injection of a liquid to be atomized. A typical example of this liquid is an insecticide, but obviously we are not to be limited to this, for it just as well could be a deodorant or even water. An internally threaded cap 24 is operatively mounted upon the body member 12, with the cap having a central aperture 50. Mounted in the central aperture 50 is a mixing element 44, in which an orifice means 46 is located. The mixing element 44 is individually illustrated in FIG. 4, and it will be described at length hereinafter.

The construction of the mixing element 44 is of considerable importance to this invention, for as a result of the configuration of this novel component, we are able to create one or more jets of gas flowing at a high rate of speed out of the orifice means 46. By the novel use of the jet or jets, we are able to achieve an extremely fine and highly advantageous atomization of the liquid inserted into the passage 20.

Figure 2:
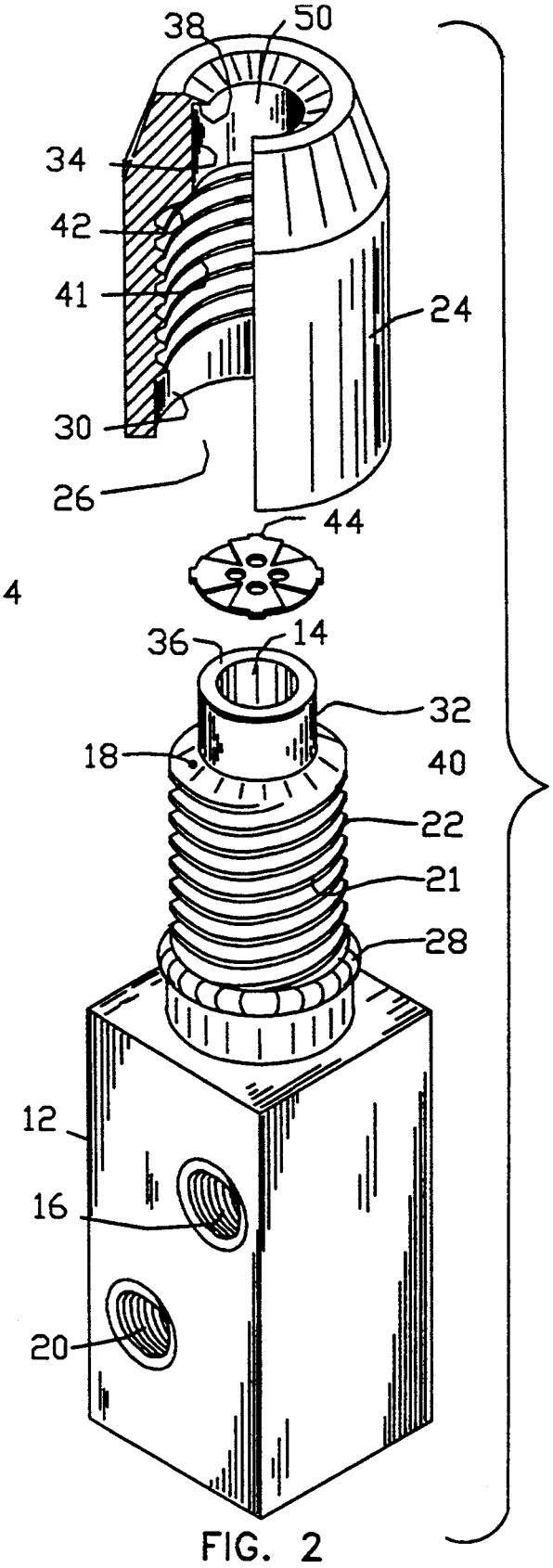
FIG. 2 is an exploded view of the atomizer of FIG. 1, revealing certain consequential details of internal construction.

Referring now to FIG. 2, it will be seen that we have shown in exploded relation, the basic components of our atomizer device, consisting of the body member 12 supporting an integral upstanding, generally cylindrically-shaped member 22 having external threads 21, upon which the internally threaded cap 24 is threadedly received. Also visible in this figure is the upward extension 32 of the generally cylindrically shaped member 22, around the uppermost part of which upward extension is a smooth circumferential surface 36.

By virtue of the body member 12 being provided with passages or fittings 16 and 20, it can be readily connected to a supply of flowing gas and to a source of liquid to be atomized, respectively. Importantly, an upwardly directed internal passage 14 extends upward along the vertical centerline of the member 22, as is apparent from FIGS. 2 and 3, which passage is adapted to accommodate the gas inserted into the threaded aperture 16.

Figure 3:
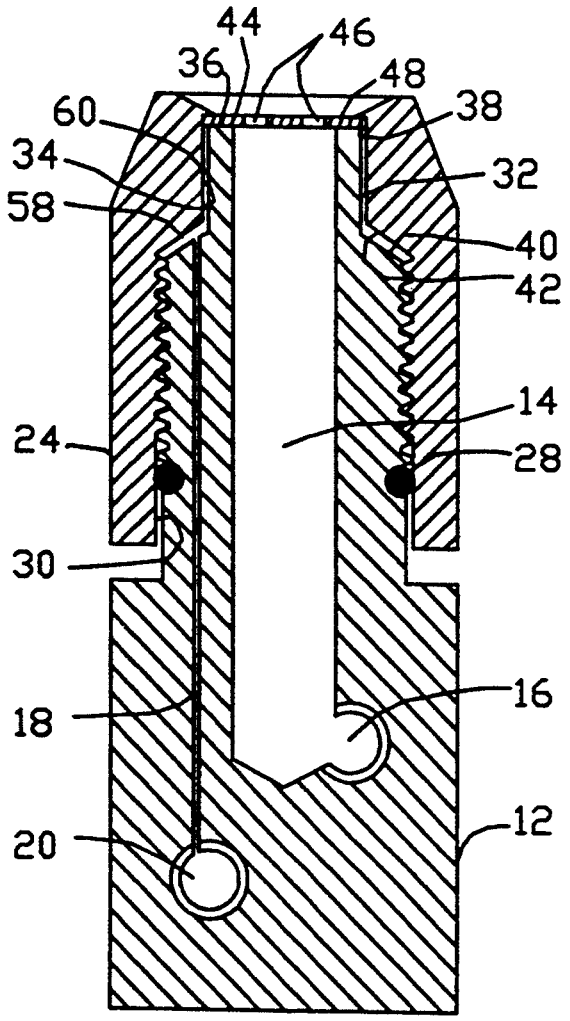
FIG. 3 is a cross-sectional view of the device of FIG. 1 to a slightly larger scale, revealing the plenums through which the liquid to be atomized flows.

From a brief reference to FIG. 3, representing a cross-sectional view through the assembled device, it will be noted that the body member 12 also has an upwardly directed internal passage 18, which is substantially smaller than passage 14, and adapted to accommodate a flowable liquid inserted into the threaded fitting 20.

From FIGS. 2 and 3 it can be seen that the external threads 21 encircling the member 22 are designed to receive the internally threaded cap 24, which is intended to be screwed tightly onto the body member 12 prior to the time of use. Because in FIG. 2 the cap is shown in exploded relation, it is readily possible to see a number of constructional details, including the fact that cap 24 contains internal threads 41 closely matching the threads 21 on the upper member 22.

Also revealed in FIG. 2 is the existence of a central hole 26 in a lower portion of cap 24, which central hole is essentially in alignment with internal gas passage 14 contained in body member 12, with the central hole 26 terminating in the previously mentioned aperture 50 in the upper part of the cap 24. Additionally shown in FIG. 2 is the skirt portion 30 that encircles the bottom of the cap 24.

Around the aperture 50 is a circumferential inner surface 38, clearly visible in FIG. 2, which is designed to retain the aforementioned novel mixing element 44 in the proper operative location shown in FIG. 3. The mixing element 44 is depicted in greater detail in FIG. 4, including the orifice means 46 utilized in this particular embodiment, and the precise construction of the mixing element 44 will be described shortly.

It is to be seen from FIGS. 2 and 3 that an O-ring 28 is mounted in a circumferential indentation disposed about the upper portion of body member 12. Both of these figures reveal that the O-ring 28 is preferably mounted below threads 21 so that the O-ring comes into sealing relationship with the inside circumferential part of skirt portion 30 of cap 24 when the cap is screwed tightly onto body member 12.

It is to be noted that the inner diameter of the upper internal passage 34 in cap 24 is slightly greater than the outer diameter of the cylindrically shaped extension 32 of body member 12.

Circumferential surface 36 at the upper end of extension 32 is perpendicular to the longitudinal centerline of extension 32. Likewise, circumferential surface 38 inside cap 24 at the upper end of internal passage 34 is perpendicular to the longitudinal centerline of cap 24.

From FIG. 2 it is to be seen that we provide a smooth conical surface 40 about the base of extension 32, into which surface the upper end of passage 18 opens. The conical surface 40 slopes slightly downwardly, and quite similarly, we provide a smooth conical interior surface 42 in a mid portion of cap 24. FIG. 3 makes clear that the surfaces 40 and 42 slope downward at essentially the same angle.

FIG. 3 shows of course the components of our novel atomizer device in an assembled relationship, with this cross-sectional view being taken through two of the gas orifices 46 located in mixing element 44. This figure reveals that the mixing element 44 is held between the interior circumferential surface 38 of the cap 24 and the upper circumferential surface 36 of the extension 32, with a sealed relationship existing between the mixing element 44 and the circumferential surface 35. Also revealed in FIG. 3 is the fact that the conical surface 42 in cap 24 is spaced somewhat apart from conical surface 40 at the lower end of extension 32, forming a truncated cone-shaped cavity 58 between these conically configured surfaces.

Additionally revealed in FIG. 3 is the fact that extension 32 of body member 12 and internal passage 34 in the upper portion of the cap 24 form between them a cylindrically-shaped cavity 60 that extends from cavity 58 to circumferential surface 36. The previously mentioned liquid passage 18 is to be seen in FIG. 3 to open into cavity 58, with this cavity and cavity 60 together serving the important function of forming a plenum that conducts liquid from passage 18 to the periphery of mixing element 44.

It has already been mentioned that a source of liquid is connected to threaded passage 20. Therefore, it is to be understood that in operation, liquid passes from threaded passage 20, through liquid passage 18, and thence into the plenum formed by cavities 58 and 60. As a result of the functioning of our device, the gas under pressure flowing upwardly through internal passage 14 extending through the body members 12 and 22 flows from the underside of the mixing element 44 outwardly through the orifices 46 in such a manner as to create jets serving in a highly advantageous way to atomize the fluid emanating from the plenum formed by cavities 58 and 60, thereby bringing about a very fine atomization of the liquid.

Figure 4:
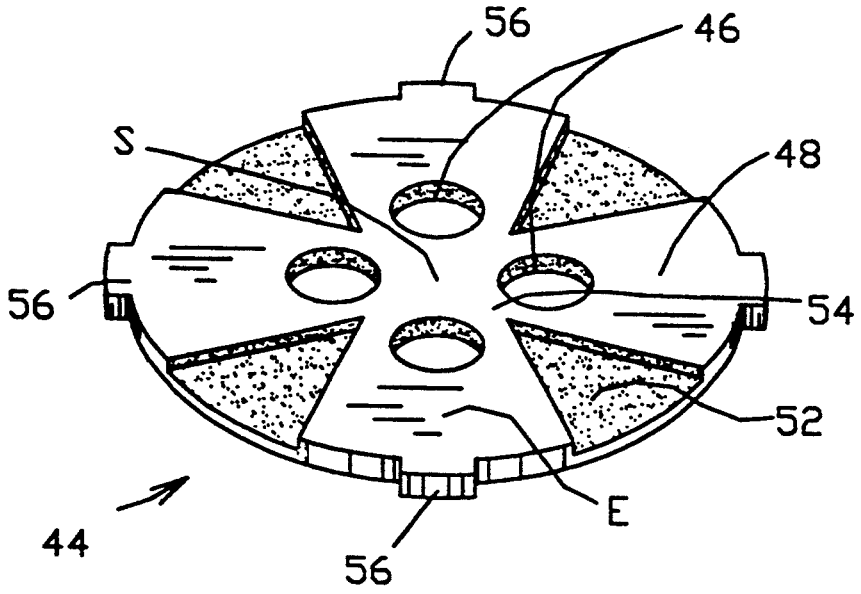
FIG. 4 is a perspective view to a substantially larger scale, of the novel mixing element utilized in one preferred embodiment of our invention.

From FIG. 4 it is to be seen that four positioning tabs 56 are located on the periphery of mixing element 44, with these positioning tabs 56 each being of the same length and being evenly spaced. The overall width of mixing element 44 is such that this element will just slip into the internal passage 34 in cap 24, with the outer edges of the positioning tabs 56 of the element 44 being in contact with the smooth sidewalls of the passage 34. As is obvious, the peripheral locations between the tabs 56 form arcuately shaped passages permitting the ingress of liquid from the plenum formed by cavities 58 and 60. As a result of this construction, the liquid can flow out from under the circumferential surface 38 and then be mixed in a very finely dispersed manner with the gas flowing under pressure through the orifice means. In this instance, we indicate the orifice means as orifices 46, but other orifice arrangements are possible, as will be set forth hereinafter. The precise functioning of this very important aspect of our invention will shortly be described.

FIG. 4 is a sufficiently large perspective view of the mixing element 44 as to enable its upper, generally smooth surface 48 to be viewed in careful detail. In this particular embodiment, four gas orifices 46 passing through the element 44 may be regarded as delineating a square on the relatively smooth upper surface 48, which we also regard as a planar surface. Each pair of adjacent gas orifices 46 are the same distance apart, and it is to be noted that the four gas orifices 46 are of such size and distance apart that they are all entirely located within a hypothetical circle on the surface 48. Significantly, the diameter of this hypothetical circle is less than the diameter of internal gas passage 14 extending through the body members 12 and 22, and it is also less than the diameter of opening 50 in cap 24. As will be noted, the part of the planar surface 48 surrounded by the four gas orifices 46 is identified in FIG. 4 as surface area S, whereas the part of surface 48 exterior to surface area S is identified as surface area E.

It is important to note from FIG. 4 that four channels or depressions 52 of equal size and substantially identical configuration are defined on the generally smooth surface 48 of the embodiment of mixing element represented by element 44, with these channels or depressions being located in each instance essentially midway between the adjacent positioning tabs 56. Each channel or depression 52 extends from the periphery of mixing element 44 to a point near what may be regarded as the outer end of a passway 54 created above surface 48 during the flow of gas from the orifices 46. Each passway extends from surface area E inwardly into central surface area S at a location between two adjoining gas orifices 46. In the illustrated embodiment, four of such passways 54 are defined immediately above the upper, generally smooth surface of this embodiment of our novel mixing element 44, with there being one passway located between each pair of the orifices 46.

As will afterward be discussed at greater length, the propellant gas flowing through the orifice means 46 creates an area of low pressure at the central portion S of the surface. Such flow of gas through the orifice means creates the above-mentioned passways extending radially inwardly from the peripheral portion to the central portion S, which passways, quite significantly, avoid direct contact with the gas jets. Because we supply a liquid to be atomized at the outer location of each such passway radially in line with the passway, the liquid is swept by ambient air through such passways toward the center of the surface, which is an area of low pressure. It is from this area that the liquid is entrained into the propellant gas flowing out of the orifice means, with this action resulting in such entrained liquid breaking in a highly advantageous manner into very fine droplets in the propellant gas.

Figure 5:
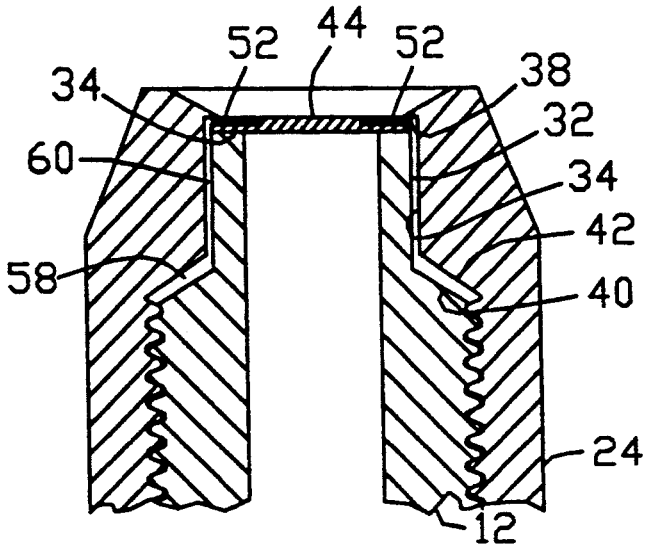
FIG. 5 is a fragmentary cross-sectional view similar to a part of FIG. 3, but differing therefrom with regard to the location of the cutting plane through the mixing element.

With reference now to FIG. 5, it is to be seen that this figure represents an enlarged partial cross-sectional view of the upper portion of the atomizer device shown in FIG. 3, with the elements in FIG. 5 being in an assembled relationship. FIG. 5 differs somewhat from FIG. 3, however, in that this cross-section, instead of being taken through the orifices 46, is taken through two of the above-described channels or depressions 52 formed in the generally smooth, upper or planar surface of the mixing element 44.

Regarding the flow of liquid to be atomized, it is most important to understand that the liquid flows from liquid passage 18 into the plenum formed by cavities 58 and 60, then flows around the periphery of mixing element 44 between the tabs 56, and thereafter out from under circumferential surface 38 of cap 24, as mentioned hereinabove. This liquid then passes through channels or depressions 52 located on the surface of the mixing element 44 to near the outer location of each passway 54, and radially in line with each passway 54, where the liquid is swept by ambient air through such passways toward the center of mixing element 44, where the liquid is mixed in a highly advantageous manner with the jets of air emanating at high speed from the orifices 46.

Figure 6:
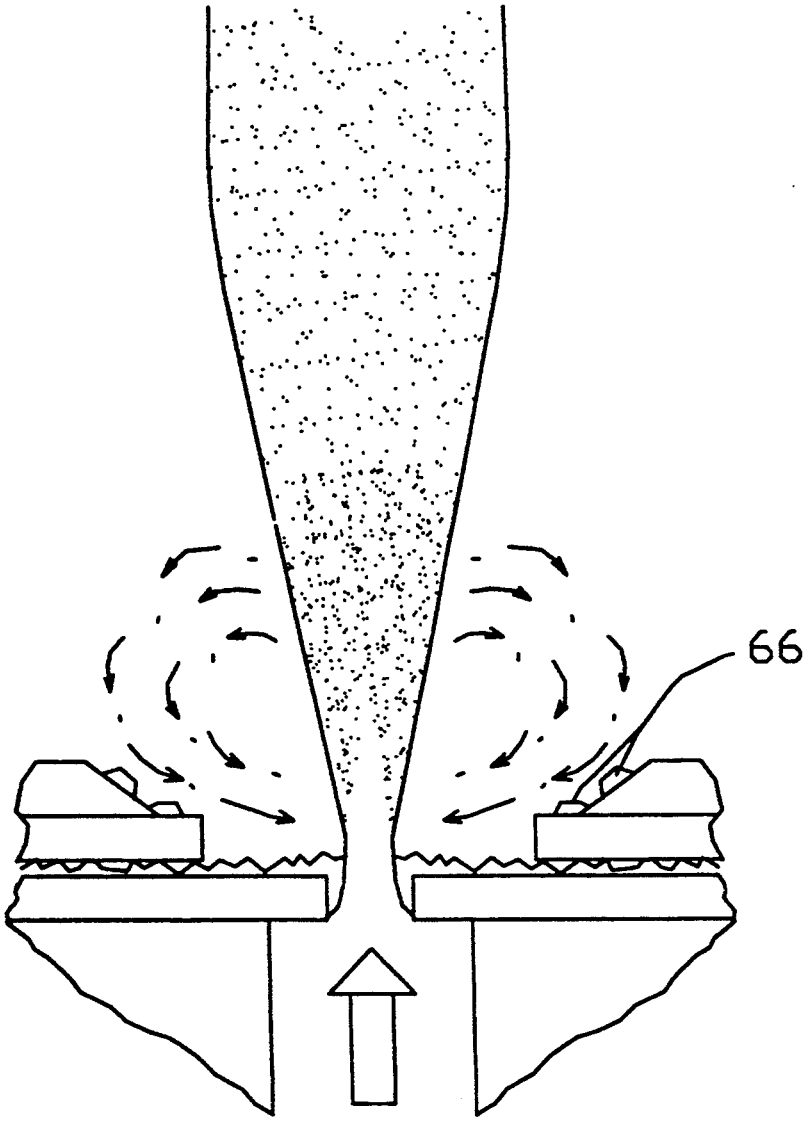
FIG. 6 is a representation of a typical eddy formed during the utilization of devices of this general type.

With the structure depicted in FIGS. 3, 4 and 5 in mind, it is to be understood that the outwardly rushing gas jets emanating from orifices 46 serves to aspirate ambient gas from the naturally occurring gas eddy above surface 48 of mixing element 44 into the outwardly flowing gas, thereby causing the ambient gas to converge toward gas orifices 46. Such a gas eddy is illustrated in FIG. 6, which will be discussed at greater length hereinafter.

Most importantly to the instant invention, the outwardly rushing gas jets also aspirate ambient gas from the space above the central surface area S, creating a slight vacuum above surface area S, such surface area being the part of the generally smooth surface 48 surrounded by the gas orifices 46.

The vacuum created above surface area S draws ambient air through such openings or passways in the overall envelope of the gas flowing out of gas orifices 46 to the space above surface area S. The converging gas drawn through the gaps or passways located between the orifices by the slight vacuum first sweeps radially inward over surface area Et then sweeps radially inward over passways 54 on mixing element 44, to reach surface area S. Channels or depressions 52 are located in surface area E and extend across surface area E from the periphery of mixing element 44 to the vicinity of passways 54, and as mentioned hereinabove, the liquid flowing from the plenums 58 and 60 onto these channels or depressions is swept into the central portion of the mixing element 44.

Figure 7:
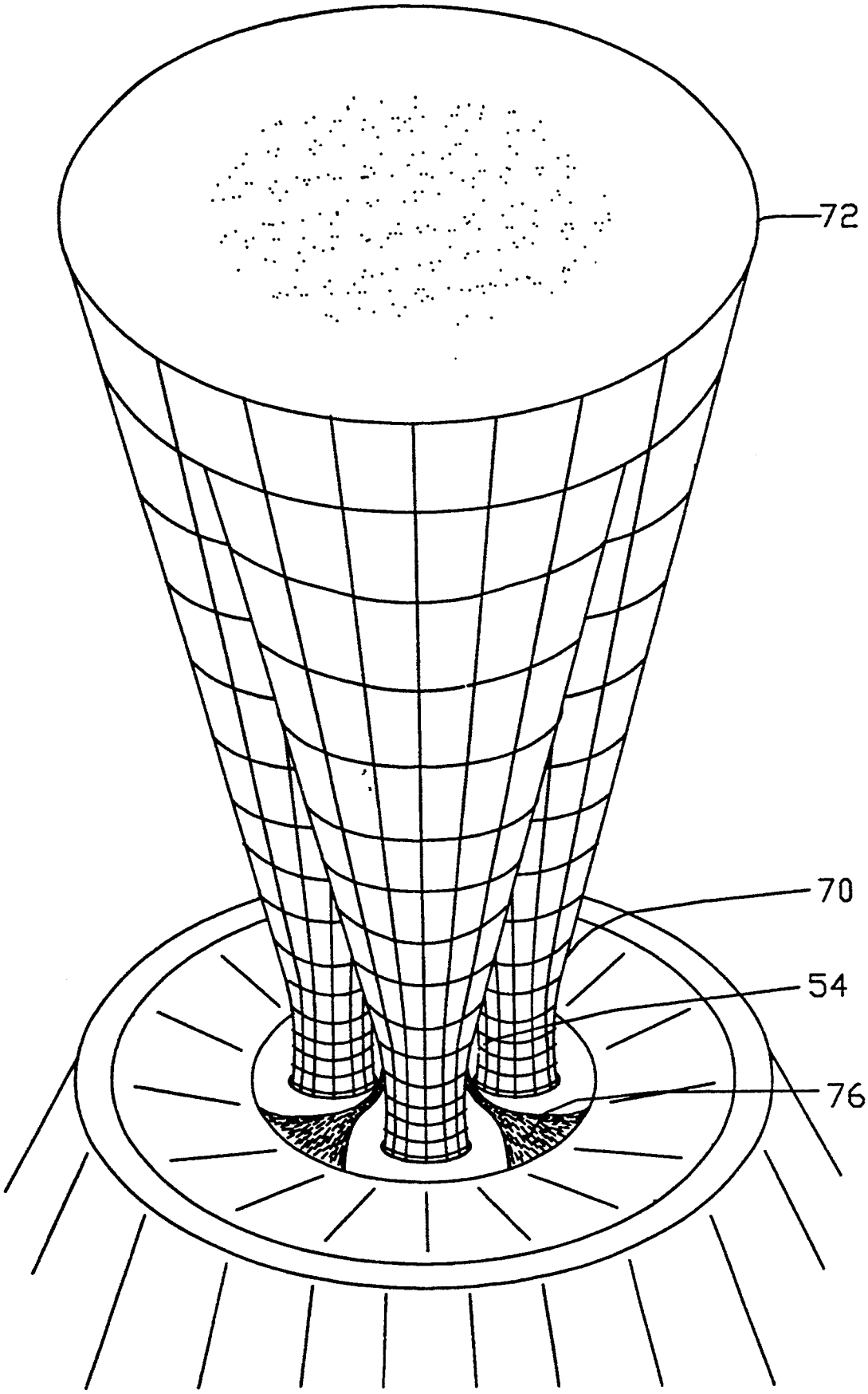
FIG. 7 represents an idealized network of flow lines of the gas and liquid flow paths created during the operation of an exemplary embodiment of our novel atomizer, with this view illustrating the location of the outer edge of the conically shaped jets of gas flowing out of each gas orifice of this novel atomizer, and also revealing how such jets eventually merge at a location above the mixing element.

With reference to FIG. 7, this represents a perspective view of the gas and liquid flow paths created by this embodiment of our novel atomizer when placed in operation. This idealized network of lines illustrates the location of the outer edge of the conically shaped stream or jet of gas 70 flowing out of each gas orifice of the atomizer, revealing how such conical streams or jets of gas merge at a location above the mixing element to form one overall conically shaped stream of gas 72 flowing out of the atomizer. Most importantly, this figure shows the passways 54 between the jets of gas 70 flowing out of each gas orifice and how liquid 76 directed to the outer location of each passway 54 at a place radially in line with the center of the passage is swept through passway 54, passing between the jets of gas 70 to reach an area of low pressure located in the central part of the mixing element, which is the area surrounded by the gas orifices.

With continuing reference to FIG. 7, it is to be understood that the horizontally disposed lines do not represent any characteristic of the flowing gas other than, in conjunction with the vertical lines, the location of the outer edge of the streams of gas flowing out of our novel atomizer.

Figure 8:
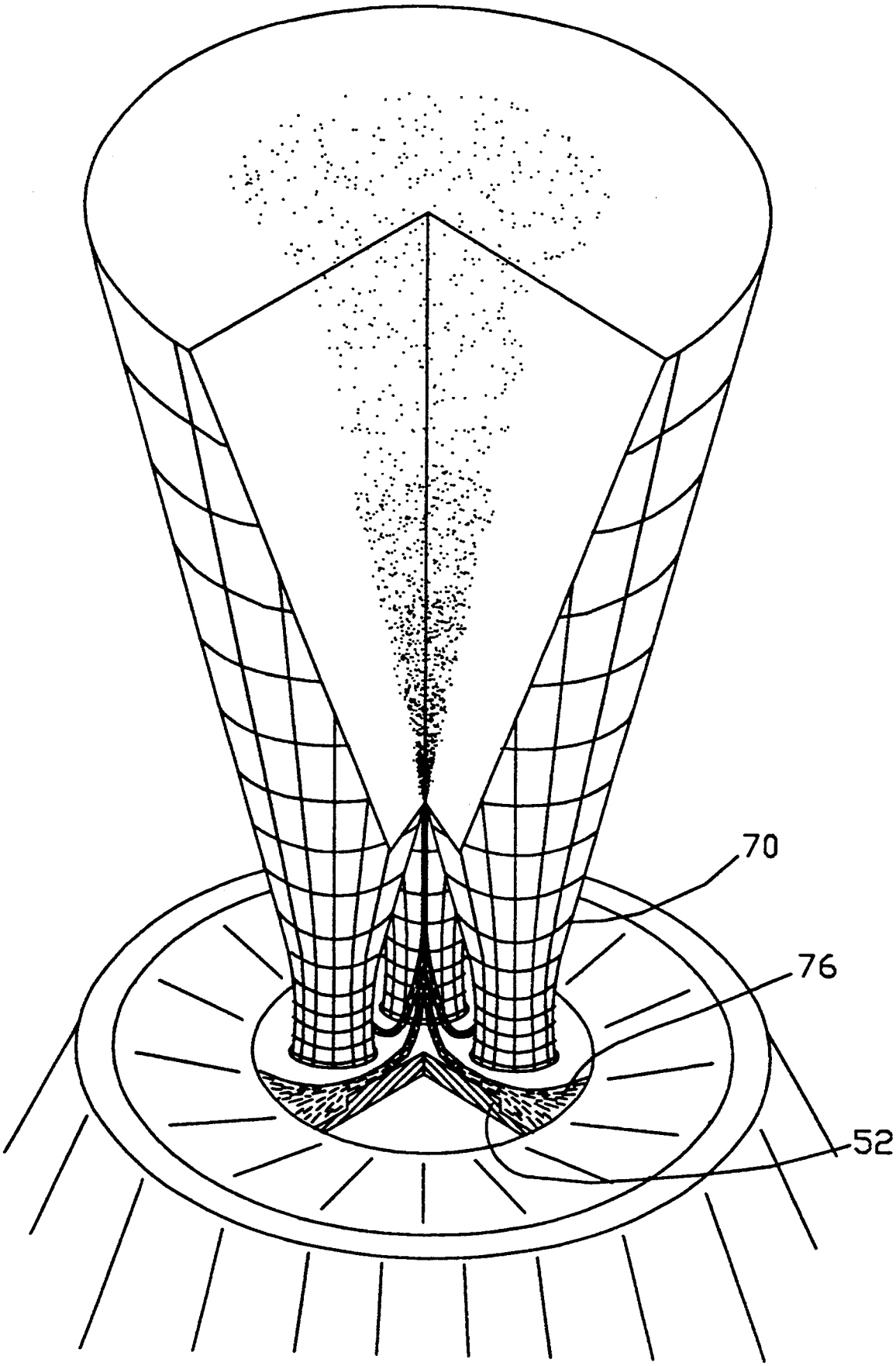
FIG. 8 is a view very similar to FIG. 7, but with a central portion cut away in order to reveal the passages between the jets of gas flowing out of each gas orifice and how liquid directed to the outer location of each passage at a place radially in line with the center of the passage is swept through such passage, avoiding contact with the jets of gas so as to reach an area of low pressure located in the central part of the mixing element.

Turning now to FIG. 8, it is to be seen that we have here removed a central portion of the showing of FIG. 7, with FIG. 8 further illustrating the path followed by liquid 76 introduced onto the active upper surface of the mixing element 44. The ambient gas flowing through passage 54 to the low pressure area at the center of surface 48 sweeps the liquid through passways 54 toward surface area S. The flowing ambient gas sweeps the liquid into thin ribbons of liquid as the liquid is swept through passways 54, which ribbons of liquid the flowing ambient gas then lifts from surface 48 and introduces into the propellant gas flowing out of gas orifices 46 at what may be regarded as the center of the overall jet of gas flowing out of the atomizer.

As should now be abundantly clear, the converging ambient gas flowing over mixing element 44 sweeps the liquid in channels 52 inward across the planar surface of the mixing element 44 toward passways 54, then through passways 54 to the surface area S, where the liquid is entrained in the propellent gas flowing out of gas orifices 46. This action causes the liquid to break up into very fine droplets in the propellent gas. The liquid is accelerated and drawn into thin ribbons, with the highly beneficial consequence that the liquid is a thin ribbon, the ideal condition for being broken up into fine droplets by the gas exiting gas orifices 46, when the liquid comes into contact with such gas.

It is to be noted that the channels 52 in surface 48 of mixing element 44 may be formed by various means, including etching, gouging, molding, pressing, and scraping.

An important aspect of the instant invention is the fact that the liquid introduced into channels 52 is directed to the outer part of passways 54, preferably at places that are along the centerline of passways 54, and quite importantly, avoiding any flow directly into the jets of gas flowing out of the orifices 46. Directing the liquid to the outer part of passways 54 results in most of the liquid flowing through the passways 54 defined between the gas jets from orifices 46 and onto surface area S of mixing element 44. The beneficial result is that most of the liquid is introduced to the propellent gas from a place that may be regarded as within the overall envelope of the propellent gas flowing out of the atomizer device. In this way, the naturally occurring gas eddy depicted in FIG. 6, that surrounds the outward flowing propellent gas, is caused to contain fewer liquid droplets, thereby substantially reducing the wetting of the face of the atomizer and diminishing the formation of large droplets 66 on the face of the atomizer that are swept into the gas flowing out of the atomizer. In this way, the number of relatively large droplets in the outflowing gas that are the consequence of large droplets 66 in FIG. 6, are reduced to an absolute minimum.

Figure 9:
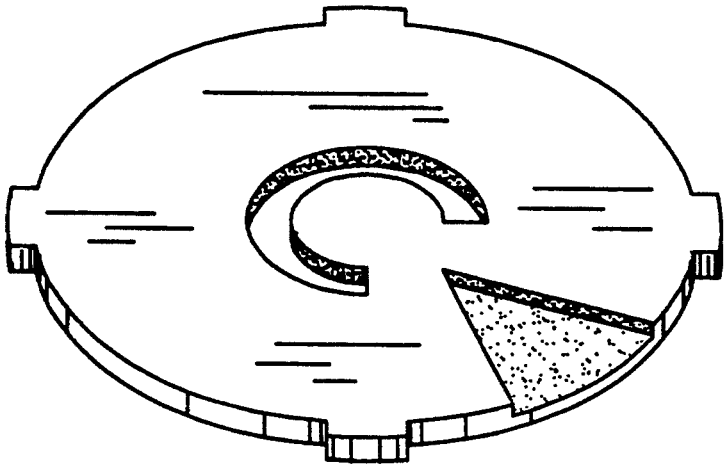
FIG. 9 is a perspective view to a large scale of a mixing element of C-shaped configuration.
Figure 10:
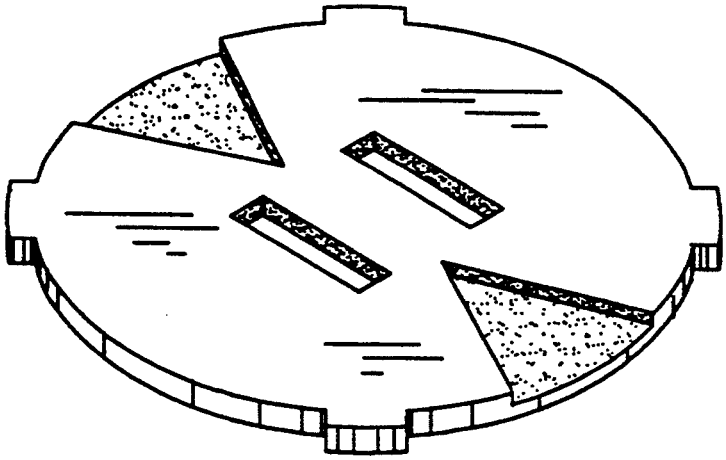
FIG. 10 is a perspective view to a large scale of a mixing element utilizing a pair of relatively closely spaced slots.

It is also important to the instant invention that the central part of surface 48 of mixing element 44 be enclosed by one or more gas orifices, except for at least one passage on surface 48 that extends between the surrounded part of surface 48 and the part of surface 48 exterior to the surrounded area. It does not matter whether the surrounded part of surface 48 be surrounded by a single gas orifice through mixing element 44, such as the surrounded area at the center of a "C" or "U" shaped gas orifice through mixing element 44, as shown in FIG. 9, or be surrounded by two gas orifices, such as the area between two long, side-by-side gas orifices through mixing element 44, as shown in FIG. 10, or be surrounded by three or more gas orifices through mixing element 44, as indicated in the earlier figures. In FIG. 9, the passway is regarded as being between the arms of the C-shaped orifice.

If there are three or more gas orifices through mixing element 44, it does not matter whether the gas orifices be of the same size, or the same shape, or the same distance separates each from its neighbor, provided the orifices sufficiently surround an area on surface 48 to create a slight vacuum above the surrounded area sufficiently strong to educt ambient gas through passways 54 with sufficient force to sweep most of the liquid at the outer locations of passways 54 on through these passways into the surrounded area.

Of consequence is the fact that there be an area on surface 48 that is sufficiently surrounded by one or more gas orifices that pass through surface 48 that the gas flowing out of the surrounding gas orifice or orifices creates a slight vacuum above the surrounded central part of surface 48 sufficiently strong to draw sufficient ambient gas through the gaps or passways in the overall envelope of the gas leaving the atomizer, that the ambient gas sweeps most of the liquid in the channels 52 through the passways between the gas orifices onto the surrounded surface area. Resulting from this action are the advantageous qualities (a) preventing most of the liquid from coming into contact with the propellent gas exiting the gas orifice or orifices except from a place that may be regarded as within the overall envelope of the gas flowing from the atomizer, and (b) drawing the liquid out into a thin ribbon before the liquid comes into contact with such propellent gas.

Figure 11:
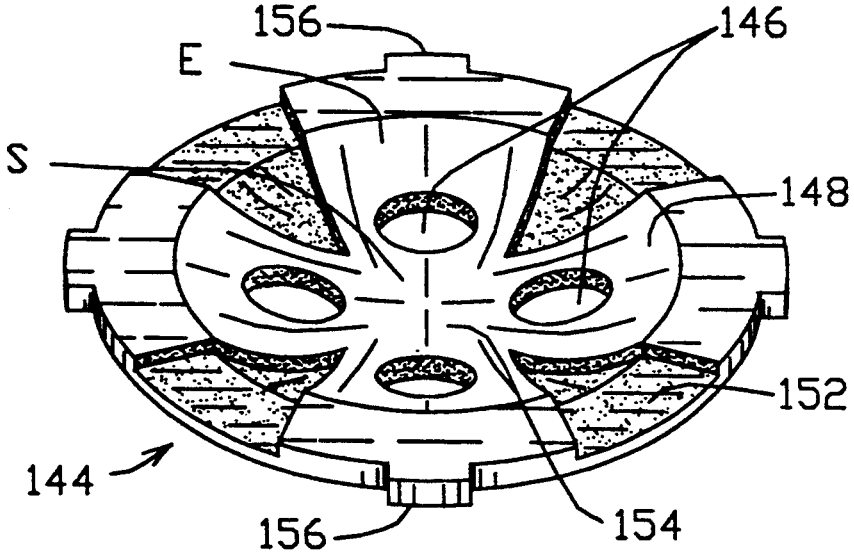
FIG. 11 is a perspective view to a large scale of a mixing element utilizing a dished central portion.

FIG. 11 is a perspective view of another form of mixing element that may be used with the embodiment of the instant invention illustrated in FIG. 1. Mixing element 144 is comparable to mixing element 44 in FIG. 4, in that both elements are generally smooth, but there are differences, these being that mixing element 144 is concave, whereas the mixing element 44 is flat. Channels 152 in surface 148 are similar to channels 52 in surface 48. It is to be noted that we have used similar reference numerals so that other like comparisons may be made.

We have found that some embodiments of the embodiment of the invention illustrated in FIG. 1 have improved operating characteristics if the center of the mixing element is slightly depressed as illustrated in FIG. 11. It should be understood with reference to mixing element 144 that surface area S, the surrounded area of surface 14, is the area bounded by the four gas orifices 146.

With reference back to the embodiment of the instant invention illustrated in FIG. 1, we have found that for both flat mixing elements, such as mixing element 44, and concave mixing elements, such as mixing element 144, that the best results are obtained when the number of gas orifices is four to eight, inclusive;

the gas orifices are circular holes of the same size; and the gas orifices surrounding the enclosed area are located in what may be regarded as the corners of a regular polygon (a polygon with equal length sides and equal interior angles).

FIGS. 12 through 15 illustrate another form of cap and mixing element that may be used with the embodiment of the instant invention illustrated in FIG. 1.

Figure 12:
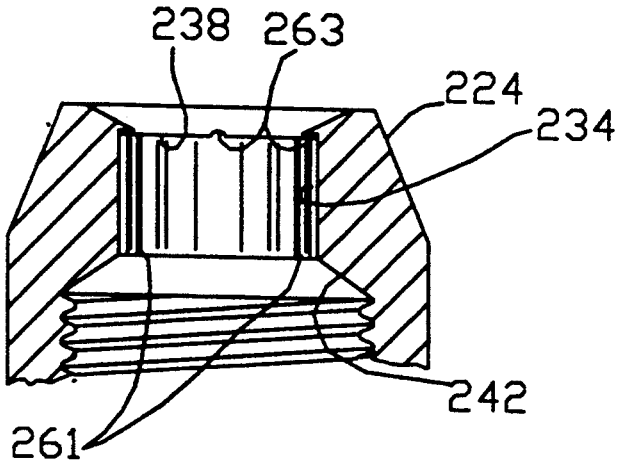
FIG. 12 is a cross-sectional view of a typical cap utilized in accordance with another embodiment of our invention, revealing certain depressions or channels in the cap.

FIG. 12 shows the upper part of cap 224, not screwed on, in cross-section. Cap 224 is comparable to cap 24 in FIGS. 1 through 3, the differences being: (1) cap 224 has grooves 261 in internal passage 234 that extend from conical surface 242 to circumferential surface 238 and (2) cap 224 has channels 263 in surface 238 that extend from the outermost edge of circumferential surface 238 to opening 250 in cap 224. Circumferential surface 238 is analogous to circumferential surface 38. We have used similar reference numerals for FIGS. 12 through 15 so that other like comparisons may be made.

Figure 14:
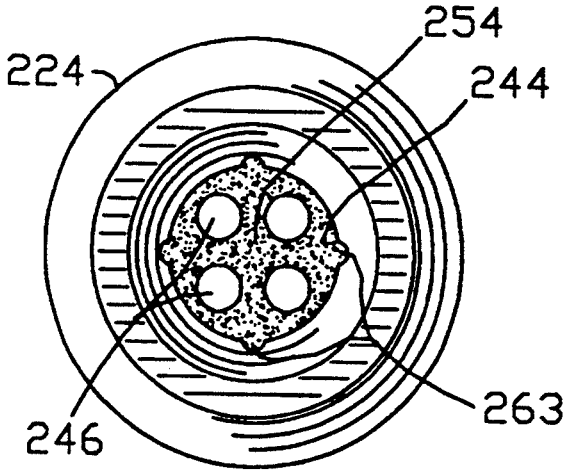
FIG. 14 is a top view of the cap of FIG. 12 with the mixing element in assembled position.
Figure 13:
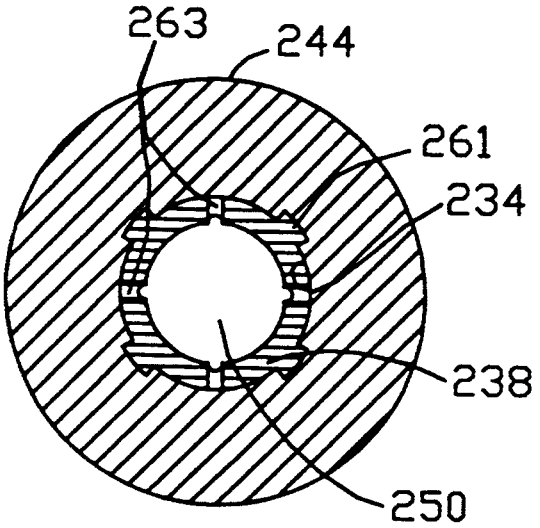
FIG. 13 is a cross-sectional view through the cap of FIG. 12, revealing the grooves and channels formed in the cap, which permit the inward flow of liquid toward the center of the mixing element.

FIG. 13 is a cross-sectional view of cap 224 showing grooves 261 and channels 263 as seen looking up into cap 224, whereas FIG. 14 is a top view of cap 224 with mixing element 244 in assembled position.

Figure 15:
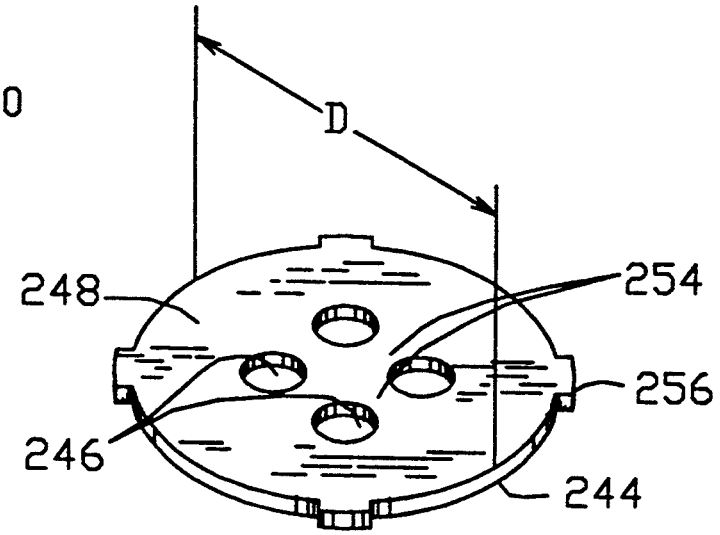
FIG. 15 is a an enlarged perspective view of a mixing element in which no channels are utilized in its upper surface, with the diameter of this mixing element being slightly less than the diameter of internal passage in cap, with tabs on this element assuring its proper orientation in the cap in which it is used.

FIG. 15 is a an enlarged perspective view of a mixing element 244, and it is to be noted that mixing element 244 is similar to mixing element 24, except mixing element 244 does not have channels in its upper surface 248, such as the channels 52 in mixing element 44. Diameter D of mixing element 244 is slightly less than the diameter of internal passage 234 in cap 224. The overall width of mixing element 244 and the width of tabs 256 are such that mixing element 244 fits in internal passage 234 of cap 224 with tabs 256 projecting into grooves 261 in internal passage 234. Tabs 256 are positioned such that mixing element 244 is oriented in cap 224 with the gaps between neighboring gas orifices 246 —the gaps being passages 254 on surface 248 of mixing element 244—in substantial alignment with channels 263.

Cap 224 and mixing element 244 may be substituted for cap 24 and mixing element 44 in the embodiment of the instant invention illustrated in the first several figures. In operation, liquid flows from a liquid supply means, through threaded passage 20, through liquid passage 18, through the plenum formed by cavities 58 and 60, around the periphery of mixing element 244, and through channels 263 in cap 224, onto surface 248 of mixing element 244 in the vicinity of the outer ends of passages 254. Pressurized gas flows from a gas supply means, through threaded passage 16, through internal passage 14, and out of the atomizer through gas orifices 246. The gas flowing out of the atomizer through gas orifices 246 sucks away gas ambient the outflowing gas, thereby causing (1) a radially inward flow of gas across surface 248 toward gas orifices 246 to replace the ambient gas sucked away and, (2) more importantly to the instant invention, a slight vacuum above the part of surface 248 surrounded by gas orifices 246. The slight vacuum draws ambient gas across surface 248 to and through passages 254 in the overall envelope of the propellant gas exiting the atomizer through gas orifices 246 to the part of surface 248 surrounded by gas orifices 246.

It is to be noted that the gas flowing across surface 248 to and through the passages in the overall envelope of the gas leaving the atomizer serves to sweep the liquid that comes through channels 263 onto surface 248, such liquid being near the outer ends of passages 254, through passways 254 to the part of surface 248 surrounded by gas orifices 246. In the process, the liquid is accelerated and formed into a thin, narrow ribbon of liquid, the ideal condition for the liquid to be in for breaking into small droplets by introducing to a fast moving flow of gas, from whence the liquid enters the outflowing propellant gas and is broken up into small droplets which are carried away by the outflowing propellant gas.

Channels 263 do not have to be less than some critical size, such as is required by Erb and Resch, U.S. Pat. No. 4,161,281. Channels 263 must open onto surface 248 near the outer ends of passways 254 so that the liquid that comes from channels 263 onto surface 248 comes onto surface 248 at a place where the ambient gas sweeping across surface 248 is gas headed to and through passways 254 in the overall envelope of the gas leaving the atomizer so that such gas will sweep such liquid through passways 254. If liquid is introduced to surface 248 at a place other than near the outer end of a passway 254, the gas flowing radially inward across surface 248 toward gas orifices 246 at places on surface 248 other than near the ends of passways 254, will sweep the liquid toward the nearest gas orifice 246, and the highly beneficial matters described herein will not occur.

We claim:

1. An atomizer device capable of reducing a flowable liquid to an ultrafine dispersion of liquid particles in a propellant gas, comprising:

a generally smooth exposed surface having a central portion as well as an outer, peripheral portion surrounding said central portion, at least one orifice means disposed in said surface in a partially surrounding relationship to said central portion, at least one gap in said at least one orifice means, forming at least one passway on and above said surface, said at least one passway extending radially inward from said outer portion to said central portion, means supplying a propellant gas to the underside of said surface, to cause such propellant gas to pass at considerable speed through said at least one orifice means, thus forming at least one gas jet, the propellant gas flowing through said at least one orifice means creating an area of low pressure at said central portion of said surface which draws a flow of ambient gas through said at least one passway, means supplying a liquid to said outer portion of said exposed surface at a location radially in line with said at least one passway and near the outer end thereof, such liquid being swept across said surface and through said at least one passway toward said area of low pressure as a consequence of the ambient gas flowing through said at least one passway toward said area of low pressure, the liquid reaching said central portion being entrained into said at least one gas jet, such entrained liquid breaking into very fine droplets int he propellant gas.

2. The atomizer device as defined in claim 1 in which said orifice means is represented by an orifice of generally C-shaped configuration, with said at least one passway being located between the arms of said C-shaped configuration.

3. The atomizer device as defined in claim 1 in which said orifice means is represented by a closely spaced pair of slots disposed in an essentially parallel relationship.

4. The atomizer device as defined in claim 1 in which said orifice means is represented by at least three orifices disposed in the configuration of a regular polygon.

5. The atomizer device as defined in claim 1 in which said generally smooth exposed surface is substantially flat.

6. The atomizer device as defined in claim 1 in which said generally smooth exposed surface has a concave central portion.

7. The atomizer device as defined in claim 1 in which said means for supplying liquid supplies such liquid at the outer end of each passway by means of a depression disposed in said generally smooth exposed surface.

8. The atomizer device as defined in claim 1 in which said generally exposed smooth surface is held in the operative position by a cap having an open central portion and a peripheral portion extending above and in contract with the peripheral portion of said generally smooth surface, at least one depression disposed in said peripheral portion of said cap adjacent said smooth surface, through which depression liquid is supplied in radial alignment with said at least one.

9. An atomizer device capable of reducing a flowable liquid to an ultrafine dispersion of liquid particles in a propellant gas, comprising:

a generally smooth surface having a central portion as well as a peripheral portion surrounding said central portion, orifice means disposed in said surface, in at least a partially surrounding relationship to said central portion, means supplying a propellant gas to the underside of said surface, to cause such propellant gas to pass at considerable speed through said orifice means, thus forming at least one gas jet, the propellant gas flowing through said orifice means creating an area of low pressure at said central portion of said surface, the flow of gas from said orifice means creating at least one passway extending radially inwardly from said peripheral portion to said central portion, which at least one passway avoids direct contact with said at least one gas jet, means supplying a liquid at the location of said at least one passway, which liquid is then swept through said at least one passway toward said area of low pressure by ambient gas flowing through said at least one passway to said area of low pressure, wherefrom the liquid is entrained into the propellant gas flowing out of said orifice means, such entrained liquid breaking into very fine droplets in the propellant gas, said orifice means being represented by an orifice of generally C-shaped configuration, with said at least one passway being located between the arms of said C-shaped configuration.

10. An atomizer device capable of reducing a flowable liquid to an ultrafine dispersion of liquid particles in a propellant gas, comprising:

a generally smooth surface having a central portion as well as a peripheral portion surrounding said central portion, orifice means disposed in said surface, in at least a partially surrounding relationship to said central portion, means supplying a propellant gas to the underside of said surface, to cause such propellant gas to pass at considerable speed through said orifice means, thus forming at least one gas jet, the propellant gas flowing through said orifice means creating an area of low pressure at said central portion of said surface, the flow of gas from said orifice means creating at least one passway extending radially inwardly from said peripheral portion to said central portion, which at least one passway avoids direct contact with said at least one gas jet, means supplying a liquid at the location of said at least one passway, which liquid is then swept through said at least one passway toward said area of low pressure by ambient gas flowing through said at least one passway to said area of low pressure, wherefrom the liquid is entrained into the propellant gas flowing out of said orifice means, such entrained liquid breaking into very fine droplets in the propellant gas, said orifice means being represented by a closely spaced pair of slots disposed in an essentially parallel relationship.

11. An atomizer device capable of reducing a flowable liquid to an ultrafine dispersion of liquid particles in a propellant gas, comprising:

a generally smooth surface having a central portion as well as a peripheral portion surrounding said central portion, orifice means disposed in said surface, in at least a partially surrounding relationship to said central portion, means supplying a propellant gas to the underside of said surface, to cause such propellant gas to pass at considerable speed through said orifice means, thus forming at least one gas jet, the propellant gas flowing through said orifice means creating an area of low pressure at said central portion of said surface, the flow of gas from said orifice means creating at least one passway extending radially inwardly from said peripheral portion to said central portion, which at least one passway avoids direct contact with said at least one gas jet, means supplying a liquid at the location of said at least one passway, which liquid is then swept through said at least one passway toward said area of low pressure by ambient gas flowing through said at least one passway to said area of low pressure, wherefrom the liquid is entrained into the propellant gas flowing out of said orifice means, such entrained liquid breaking into very fine droplets in the propellant gas, said means for supplying a liquid being disposed at the peripheral portion of said surface, at a location radially in line with said at least one passway, said generally smooth surface being held in the operative position by a cap having an open central portion and a peripheral portion extending above and in contact with the peripheral portion of said generally smooth surface, at least one depression disposed in said peripheral portion of said cap adjacent said smooth surface, through which depression liquid is supplied in radial alignment with said at least one passway.

12. An atomizer device capable of reducing a flowable liquid to an ultrafine dispersion of liquid particles in a propellant gas, comprising:

a generally smooth surface having a central portion as well as a peripheral portion surrounding said central portion, orifice means disposed in said surface, in a surrounding relationship to said central portion, means for supplying a propellant gas to the underside of said surface, to cause such propellant gas to pass at considerable speed through said orifice means, thus forming at least one gas jet, the propellant gas flowing through said orifice means creating an area of low pressure at said central portion of said surface, the flow of gas from said orifice means creating at least one passway extending radially inwardly from said peripheral portion to said central portion, through which at least one passway ambient air is educted to said area of low pressure, avoiding direct contact with said at least one gas jet, means supplying at said peripheral portion of said surface radially in line with said at least one passway, a liquid to be atomized, which liquid is swept by such educted air through said at least one passway toward said area of low pressure, wherefrom the liquid is entrained into the propellant gas flowing out of said orifice means, such entrained liquid breaking into very fine droplets in the propellant gas, said orifice means being represented by an orifice of generally C-shaped configuration, with said at least one passway being located between the arms of said C-shaped configuration.

13. An atomizer device capable of reducing a flowable liquid to an ultrafine dispersion of liquid particles in a propellant gas, comprising:

a generally smooth surface having a central portion as well as a peripheral portion surrounding said central portion, orifice means disposed in said surface, in a surrounding relationship to said central portion, means for supplying a propellant gas to the underside of said surface, to cause such propellant gas to pass at considerable speed through said orifice means, thus forming at least one gas jet, the propellant gas flowing through said orifice means creating an area of low pressure at said central portion of said surface, the flow of gas from said orifice means creating at least one passway extending radially inwardly from said peripheral portion to said central portion, through which at least one passway ambient air is educted to said area of low pressure, avoiding direct contact with said at least one gas jet, means supplying at said peripheral portion of said surface radially in line with said at least one passway, a liquid to be atomized, which liquid is swept by such educted air through said at least one passway toward said area of low pressure, wherefrom the liquid is entrained into the propellant gas flowing out of said orifice means, such entrained liquid breaking into very fine droplets in the propellant gas, said orifice means being represented by a closely spaced pair of slots disposed in an essentially parallel relationship.

14. An atomizer device capable of reducing a flowable liquid to an ultrafine dispersion of liquid particles in a propellant gas, comprising:

a generally smooth surface having a central portion as well as a peripheral portion surrounding said central portion, orifice means disposed in said surface, in a surrounding relationship to said central portion, means for supplying a propellant gas to the underside of said surface, to cause such propellant gas to pass at considerable speed through said orifice means, thus forming at least one gas jet, the propellant gas flowing through said orifice means creating an area of low pressure at said central portion of said surface, the flow of gas from said orifice means creating at least one passway extending radially inwardly from said peripheral portion to said central portion, through which at least one passway ambient air is educted to said area of low pressure, avoiding direct contact with said at least one gas jet, means supplying at said peripheral portion of said surface radially in line with said at least one passway, a liquid to be atomized, which liquid is swept by such educted air through said at least one passway toward said area of low pressure, wherefrom the liquid is entrained into the propellant gas flowing out of said orifice means, such entrained liquid breaking into very fine droplets in the propellant gas, said generally smooth surface being held in the operative position by a cap having an open central portion and a peripheral portion extending above and in contact with the peripheral portion of said generally smooth surface, at least one depression disposed in said peripheral portion of said cap adjacent said smooth surface, through which depression liquid is supplied in radial alignment with said at least one passway.

* * * * *